US005769014A

United States Patent [19]

Mori

[11] Patent Number: 5,769,014

[45] Date of Patent: Jun. 23, 1998

[54] RUFFLING DEVICE FOR MOUNTING ON A SEWING MACHINE

[76] Inventor: Mikio Mori, 13-2, Chidori-cho 3-chome, Ogaki-shi, Gifu-ken, Japan

[21] Appl. No.: 829,877

[22] Filed: Apr. 2, 1997

[30] Foreign Application Priority Data

Apr. 3, 1996 [JP] Japan ..... 8-081580

[51] Int. Cl.[6] ..... D05B 35/08

[52] U.S. Cl. ..... 112/134

[58] Field of Search ..... 112/134, 132, 112/135, 133, 144, 145, 146

[56] References Cited

U.S. PATENT DOCUMENTS

| | | | |
|---|---|---|---|
| 4,108,094 | 8/1978 | Weigert | 112/134 |
| 5,315,942 | 5/1994 | Pantusco et al. | 112/134 |
| 5,562,058 | 10/1996 | Niino | 112/134 |

*Primary Examiner*—Peter Nerbun

*Attorney, Agent, or Firm*—Dennison, Meserole, Pollack & Scheiner

[57] ABSTRACT

A ruffling device adapted for mounting on a sewing machine, includes: a base for attachment to a presser bar of the sewing machine, a pivotal lever mounted on the base connected to a needle bar of the sewing machine, so that the pivotal lever may be reciprocally pivoted as a needle-bar is vertically reciprocally moved; a work folding lever for folding a work fabric and movable in forward and rearward directions with respect to a feeding direction of the work fabric for a sewing operation, a motion conversion mechanism for converting the pivotal movement of the pivotal lever into the forward and rearward movement of the work folding lever, so that the work folding lever cooperates with a presser foot mounted on the base for forming a ruffle on the work fabric, a timing adjusting device for adjusting an operation timing of the work folding lever, and a stroke adjusting device for adjusting a stroke of movement of the work folding lever.

4 Claims, 17 Drawing Sheets

RUFFLING DEVICE FOR MOUNTING ON A SEWING MACHINE

BACKGROUND OF THE INVENTION

1. Field of the Invention

The present invention relates to a gather forming device adapted for mounting on a sewing machine.

2. Description of the Prior Art

A conventional ruffling device includes a base plate for mounting on a presser bar of a sewing machine. A pivotal lever is vertically pivotally mounted on a support shaft of the base plate and is connected to a needle bar of the sewing machine, so that the pivotal lever is vertically reciprocally pivoted as the needle bar is driven. As the pivotal lever is pivoted, a work folding lever having a work folding plate is pivoted forwardly and rearwardly in one of a plurality of operational modes which can be selected by an operator. As the work folding plate is reciprocally moved in forward and rearward directions, the work folding plate cooperates with a work presser foot provided on the base plate so as to form ruffles on a work fabric.

In order to enable the selection of the operational modes of the work folding plate, a conversion mechanism is provided between the pivotal lever and the work folding lever. The conversion mechanism includes a ratchet wheel rotatably mounted on the support shaft and includes a claw mounted on the pivotal lever for engagement with the ratchet wheel. The ratchet wheel includes a plurality of engaging recesses arranged in the circumferential direction, so that the ratchet wheel is rotated through engagement of the claw for each upward pivotal movement of the pivotal lever. Thus, the ratchet wheel is intermittently rotated as the needle bar moves reciprocally. The engaging recesses include two deeper recesses having a depth greater than others. When the claw is brought to engage any of the deeper recesses, the claw confronts a part of the work folding lever, so that the work folding lever is pivoted by the pivotal lever by means of the claw and that the work folding plate is moved forwardly toward the work presser foot of the base. In order to return the work folding plate in the rearward direction, a screw is mounted on the work folding lever, so that the pivotal lever abuts on the screw to pivot the work folding lever rearwardly. Here, the work folding lever is normally held in position relative to the base by frictional force, so that the work folding plate is held in its rearmost stroke end until the work folding lever is forced to be pivoted again by the pivotal lever. The stroke of the work folding plate is determined by the position of the rearmost stroke end since the position of the frontmost stroke end is unchanged.

The claw can be shifted relative to the pivotal lever in the lateral direction (direction parallel to the support shaft). A side plate is secured to the lateral surface of the ratchet wheel to cover one of the deeper recesses by the height which is the same as the bottom of the other engaging recesses having shallower depth. Therefore, when the position of the claw is shifted laterally to a second position where the claw extends over the cover plate, the claw engages this one of the deeper recesses with the claw positioned on the cover plate, so that the claw in this second position may not abut on the work folding lever for pivoting the same. This means that two kinds of operation modes of the work folding plate are available. In addition, when the claw is moved laterally to a third position where the claw directly confronts the part of the work folding lever, the work folding plate performs one stroke movement for each stroke movement of the pivotal lever. Thus, three different operational modes of the work folding plate are available. Here, the stroke of the work folding plate can be adjusted by the screw described above.

The conventional ruffling device however involves the following disadvantages:

(1) The device is limited in use since only three operational modes are available.

(2) The work folding lever in the rearmost stroke end is held in position by the frictional force, and the rearmost stroke end thus held determines the stroke of the work folding plate. Therefore, the rearmost stroke end is liable to be varied by vibrations applied to the work folding lever during operation. In addition, the stroke cannot be accurately determined.

(3) The work folding plate is moved forwardly through abutment of the claw on the work folding lever and is moved rearwardly through abutment of the pivotal lever on the screw. Therefore, unpleasant sounds may be produced by the abutment of these elements. In addition, in either of forward and rearward movements of the work folding plate, there are certain time gaps between the movement of the pivotal lever and the movement of the work folding lever or the work folding plate. Therefore, the operation timing as well as the stroke of the work folding plate cannot be accurately controlled.

SUMMARY OF THE INVENTION

It is, accordingly, an object of the present invention to provide a ruffling device adapted for mounting on a sewing machine, which can be operated at various operation timings and with various strokes of movement of a work folding plate.

It is another object of the present invention to provide such a ruffling device in which a stroke and an operation timing of a work folding plate can be reliably accurately determined.

According to the present invention, there is provided a ruffling device adapted for mounting on a sewing machine, comprising:

a) a base for attachment to a presser bar of the sewing machine;

b) a pivotal lever mounted on the base and connected to a needle bar of the sewing machine, so that the pivotal lever can be reciprocally pivoted as a needle bar is vertically reciprocally moved;

c) a work folding lever adapted for folding a work fabric and movable in forward and rearward directions with respect to a feeding direction of the work fabric for a sewing operation;

d) a motion conversion mechanism for converting the pivotal movement of the pivotal lever into the forward and rearward movements of the work folding lever, so that the work folding lever cooperates with a presser foot mounted on the base for forming ruffles on the work fabric;

e) a timing adjusting mechanism for adjusting an operation timing of the work folding lever; and f) a stroke adjusting mechanism for adjusting a stroke of movement of the work folding lever in the forward and rearward directions;

the motion conversion mechanism including a link mechanism having a plurality of link members connected to each other;

the timing adjusting mechanism comprising:

a plurality of cam disks intermittently rotated by the pivotal lever, each of the cam disks having a predetermined number of cam recesses formed on an outer circumferential surface thereof;

a timing adjusting lever operable by an operator for selectively cooperating with one of the cam disks, the timing adjusting lever having a claw for engagement with the cam recesses, so that the timing adjusting lever is movable between an operative position where the claw is in engagement with one of the cam recesses and an inoperative position where the claw abuts on the outer circumferential surface other than the cam recesses;

a switching mechanism provided between the timing adjusting lever and the link mechanism connecting the link mechanism to the work folding lever when the timing adjusting lever is in the operative position and to disconnect the link mechanism from the work folding lever when the timing adjusting lever is in the inoperative position;

the stroke adjusting mechanism including a stroke adjusting lever operable by the operator for varying a stroke of pivotal movement of any of the link members of the link mechanism.

With this construction, the timing of movement of the work folding lever can be easily determined according to the positions of the cam recesses and the number of the cam recesses on each cam disk. In addition, the number of different modes of movement of the folding lever can be increased by increasing the number of the cam disks. The device can therefore be used in various applications.

The motion conversion mechanism for converting the pivotal movement of the pivotal lever into the forward and rearward movements of the work folding lever comprises the link mechanism which includes the link members. The stroke of movement of the work folding lever can be varied by varying the pivotal stroke of any one of the link members. Therefore, the stroke of the work folding lever can be accurately and reliably determined without being influenced by vibrations during the sewing operation. In addition, the operation timing of the folding lever can be reliably controlled.

Preferably, the link members of the link mechanism comprise a first link member pivotally connected to the pivotal lever, a second link member pivotally connected to the work feeding means, and an intermediate link member connected between the first link member and the second link member. The first link member and the intermediate link member are connected to each other by means of an elongate slot formed in the first link member and a pin provided on the intermediate link member for engagement with the elongate slot. The switching mechanism includes a switching lever mounted on the first link member and connected to the timing adjusting lever. The switching lever is movable between a connecting position and a disconnecting position. The switching lever in the connecting position extends across the elongate slot for preventing the pin from moving relative to the elongate slot, so that a pivotal movement of the first link member is transmitted to the intermediate link member. The switching lever in the disconnecting position is positioned away from the elongate slot for permitting movement of the pin relative to the elongate slot, so that the pivotal movement of the first link member is not transmitted to the intermediate link member.

With this construction, the link mechanism and the switching mechanism can be easily manufactured.

Preferably, the intermediate link member and the second link member are connected to each other by means of a second pin provided on the second link member and a second elongate slot formed in the second link member. The stroke adjusting lever is connected to the second pin and is operable to vary the position of the second pin relative to the second elongate slot so as to vary the distance between a pivotal axis of the second link member and the second pin, so that the stroke of pivotal movement of the second link member is varied.

With this construction, the stroke of the work folding lever can be adjusted without causing any influence on the operation of the link mechanism and the switching mechanism.

Preferably, the cam disks of the timing adjusting mechanism are mounted on a support shaft and are rotatable together relative to the support shaft. The timing adjusting mechanism further includes a ratchet wheel rotatable with the cam disks, a detent member for permitting rotation of the ratchet wheel in only one direction, a connecting arm adapted to be pivoted by the pivotal lever, and a feeding claw provided on the connecting arm for engagement with the ratchet wheel, so that the cam disks are intermittently rotated as the ratchet wheel is rotated through engagement of the feeding claw with the ratchet wheel for each pivotal movement of the connecting arm.

With this construction, the cam disks in any desired number can be easily incorporated.

The invention will become more fully apparent from the claims and the description as it proceeds in connection with the drawings.

DETAILED DESCRIPTION OF THE PREFERRED EMBODIMENT

An embodiment of the present invention will now be explained with reference to the drawings.

Figure 1:
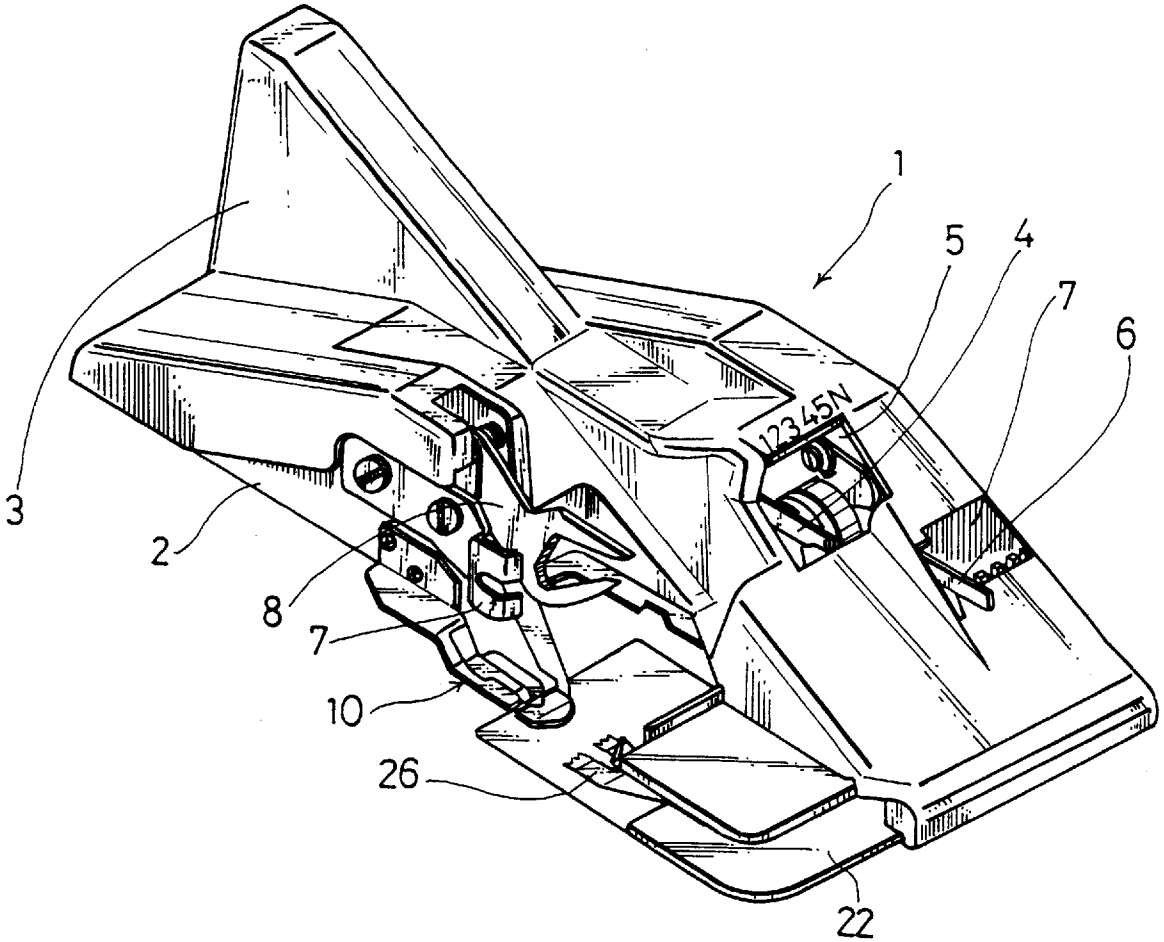
FIG. 1 is a perspective view of a ruffling device according to an embodiment of the present invention.

FIG. 1 shows a ruffling device 1 in perspective view and includes a base plate 2 on which various mechanisms to be explained later are mounted. A cover 3 is provided for covering these mechanisms from the outside. The rear portion of the cover 3 includes a first opening 5 and a second opening 7. A timing adjusting lever 4 is provided for adjusting a timing of movement of a work folding lever 24 which serves to form a ruffle on a work fabric as will be explained later. The timing adjusting lever 4 has one end extending outwardly from the first opening 5. A stroke adjusting lever 6 for adjusting a stroke of movement of the work folding lever has one end extending outwardly from the second opening 7. Thus, an operator can operate the timing adjusting lever 4 and the stroke adjusting lever 6 from the outside of the cover 3. The cover 3 is removably fixed to the base plate 2 by means of screws (not shown).

Figure 2:
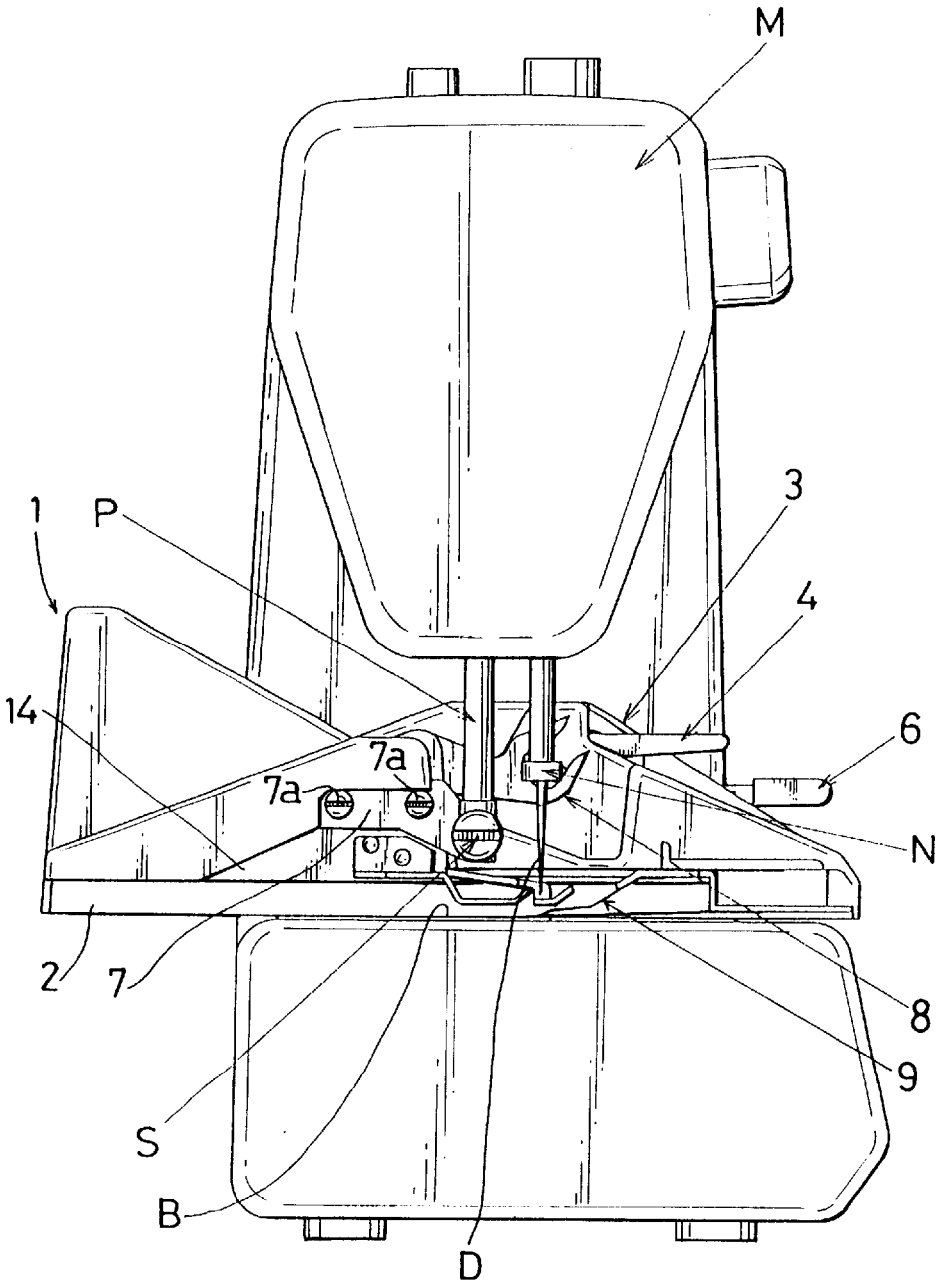
FIG. 2 is a side view of the device mounted on a sewing machine.

In this description, a normal feeding direction of a work for a sewing operation of a sewing machine M shown in FIG. 2 is called "forward direction", and the direction opposite to the feeding direction is called "rearward direction".

Figure 3:
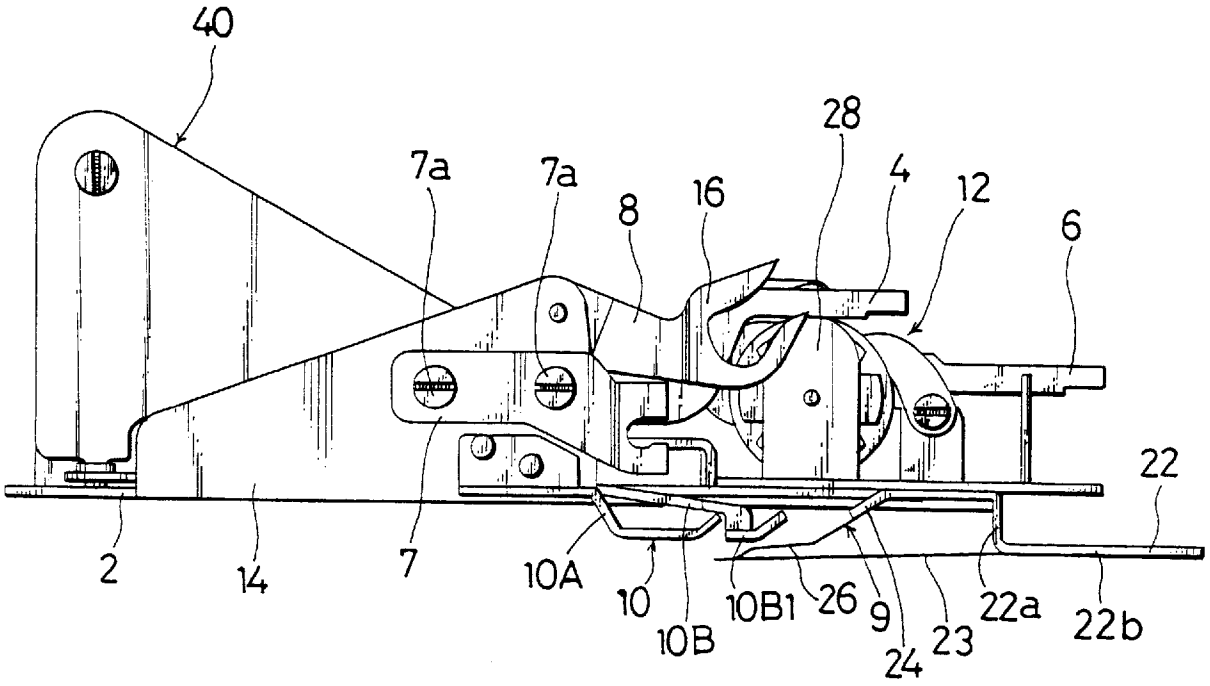
FIG. 3 is a side view of the device with its cover removed.
Figure 4:
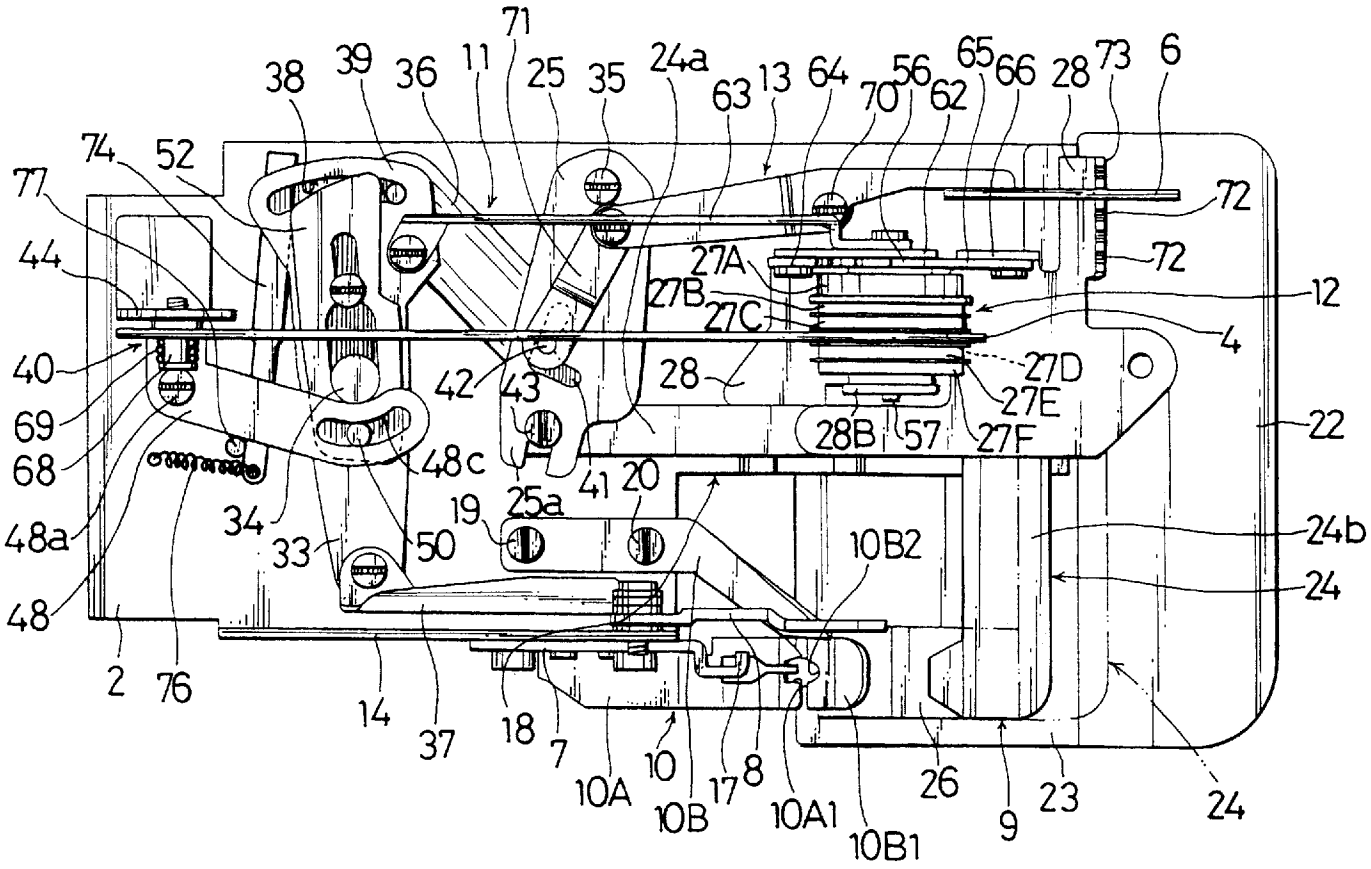
FIG. 4 is a plan view of FIG. 3.

The ruffle device 1 in the mounting state on the sewing machine M is shown in FIG. 2, and the device 1 with the cover 3 removed is shown in FIGS. 3 and 4 in side view and in plan view, respectively. As shown in these figures, the device 1 generally comprises the followings:

- a mounting member 7 for detachably mounting the device 1 on a presser bar P of the sewing machine M by means of a screw S;
- a pivotal lever 8 connected to a needle bar N of the sewing machine M which is reciprocally vertically pivoted as the needle bar N is driven;
- a work folder 9 having the work folder lever 24 which is movable in the forward and rearward directions relative to the base plate 2;
- a motion conversion mechanism 11 for converting the pivotal movement of the pivotal lever 8 into the forward and rearward movements of the work folder lever 24, so that the work folder lever 24 cooperates with a presser foot 10 mounted on the base plate 2 for ruffles on with a work fabric;
- a timing adjusting mechanism 12 having the timing adjusting lever 4 and operable for adjusting the operation timing of the work folding lever 24; and
- a stroke adjusting mechanism 13 having the stroke adjusting lever 6 and operable for adjusting the stroke in the forward and rearward directions of the work folding lever 24.

The mounting member 7 is secured to a support plate 14 which extends upwardly from the left side edge of the base plate 2 and which is formed integrally with the base plate 2. The mounting member 7 has one end having a substantially U-shaped configuration conforming to the contour of the presser bar P.

The pivotal lever 8 has one end pivotally connected to the support plate 14 by means of a pin 15 in a position above the mounting plate 7, so that the pivotal lever 8 is vertically pivotable relative to the base plate 2. A bifurcated part 16 is formed on the other end of the pivotal lever 8 and serves to receive the shank of a screw (now shown) which is usually provided on this kind of sewing machine for fixing a sewing needle D to the needle bar N, so that the pivotal lever 8 is vertically pivoted in synchronism with the vertical movement of the needle bar 8.

The presser foot 10 is positioned below the pivotal lever 8 and comprises a main foot part 10A and an auxiliary foot part 10B. The main foot part 10A is secured to the support plate 14 and extends rearwardly therefrom. The auxiliary foot part 10B is secured to the base plate 2 in a position laterally spaced from the support plate 14. The auxiliary foot part 10B extends obliquely leftwardly from the base plate 2 and has a rear end 10B1 positioned rearwardly of the main foot part 10A, so that a predetermined space is formed between the rear end 10B1 and the main foot part 10A. In order to properly and smoothly feed the work fabric for the sewing operation with the work fabric positioned between the presser foot 10 and a bed B of the sewing machine M, the presser foot 10 should be positioned at an appropriate height for pressing the work fabric on a feed dog (not shown) provided in the bed B of the sewing machine. To this end, with this embodiment, the mounting member 7 is detachably mounted on the support plate 14 by means of screws 7*a*. The mounting member 7 can be suitably selected among plural kinds of mounting members which are prepared for providing different mounting heights.

The main foot part 10A of the presser foot 10 has a bifurcated rear end formed with a substantially U-shaped recess 10A1. A leaf spring 17 is fixed to the upper surface of the main foot part 10A and has a free end which extends into the recess 10A1 to some extent. The rear end 10B1 of the auxiliary foot part 10B has a needle hole 10B2 which confronts the recess 10A1 and which has a substantially semicircular configuration, so that the sewing needle D can be moved to pass through the needle hole 10B2 for the sewing operation. In order to cope with various types of sewing machines, it is preferable that the needle hole 10B2 has a relatively large width.

Figure 5:
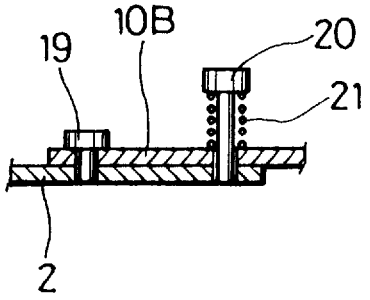
FIG. 5 is a sectional view showing the mounting state of an auxiliary foot part on a base plate of the device.

The base plate 2 has a rear portion including a cut-out 18 on its left side (on the side of the support plate 14), so that the auxiliary foot part 10B extends obliquely across the cut-out 18 as shown in FIG. 4. Here, the auxiliary foot part 10B is secured to the base plate 2 at two positions in the forward and rearward directions by means of screws 19 and 20, respectively. As shown in FIG. 5, a compression spring 21 is interposed between a head of the screw 20 and the auxiliary foot part 10B, so that the auxiliary foot part 10B is normally held in a position where the lower surface of the rear end 10B1 extends at the same level as the lower surface of the rear end of the main foot part 10A, while the rear end 10B1 may be lifted to some extent during the ruffling operation as will be explained later.

A work guide plate 22 extends rearwardly from the base plate 2 and includes a front portion 22*a* which has a substantially inverted L-shaped configuration in side view as shown in FIG. 3. The front portion 22*a* is superposed on the rear end of the base plate 2. A plate spring 23 is secured to a left side part of a rear portion 22*b* of the work guide plate 22, so that the plate spring 23 is positioned in the cut-out 28. The plate spring 23 has a front end or a free end which is adapted to resiliently abut on the bed B and which is positioned below the auxiliary foot part 10B. The plate spring 23 has a recess (not shown) at a position corresponding to the needle hole 10B2, so that the sewing needle D does not cause interference with the plate spring 23.

Figure 9:
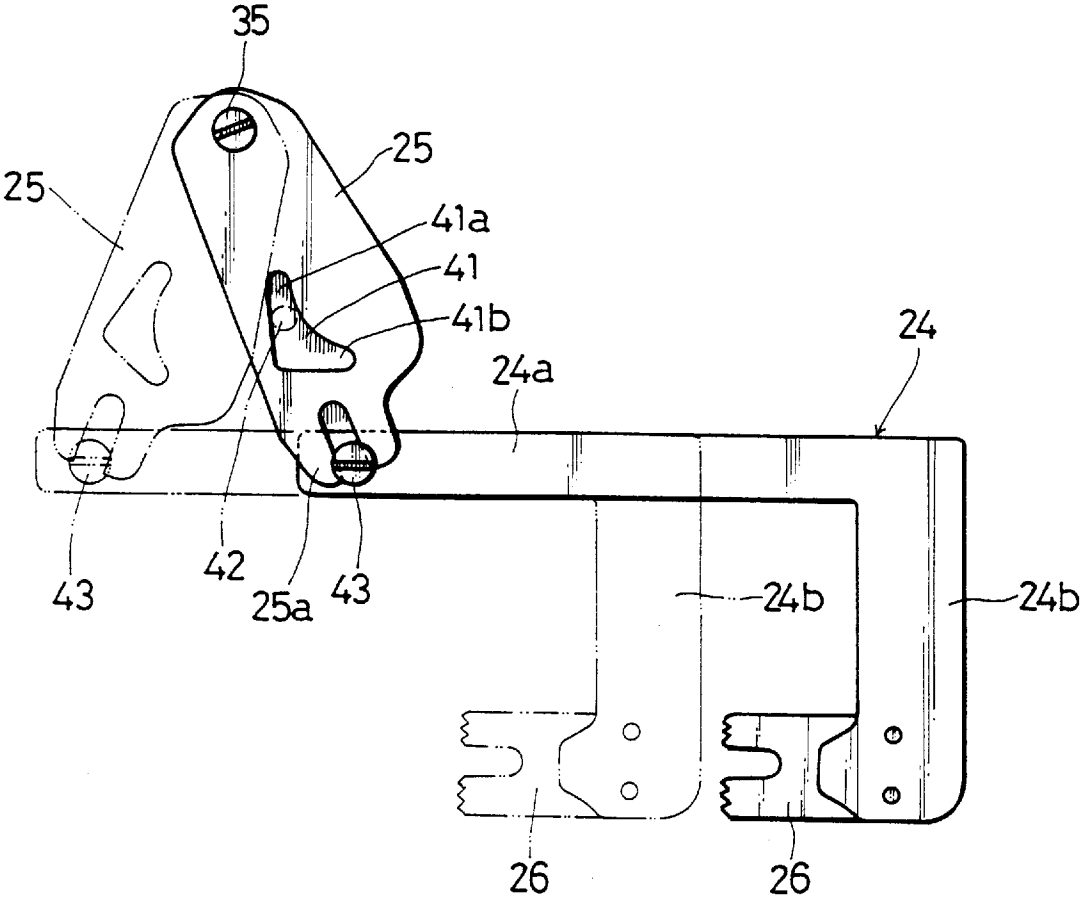
FIG. 9 is a plan view showing the relation between a second link lever and the work folding lever.

The work folding lever 24 of the work folder 9 has a substantially L-shaped configuration in plan view and which is slidably mounted on a part of the base plate 2 on the lateral side of the cut-out 18. The work folding lever 24 has a slide bar part 24*a* and a mounting part 24*b* for mounting a work folding plate 26 thereon. The slide bar part 24*a* has a front end connected to a second link member 25 of the conversion mechanism 11. The mounting part 24*b* extends leftwardly at substantially right angles from the rear end of the slide bar part 24*b*. The work folding plate 26 is made of a leaf spring and extends forwardly from the mounting part 24*b* of the work folding lever 24. The work folding plate 26 has a rear end which has a recess corresponding to the needle hole 10B2 of the auxiliary foot part 10B and which has a saw blade-like edge as shown in FIG. 9. When the work folding lever 24 is moved forwardly, the work folding plate 26 enters between the auxiliary foot part 10B and the spring plate 23 so as to form a ruffle on the work fabric as will be explained later.

Figure 6:
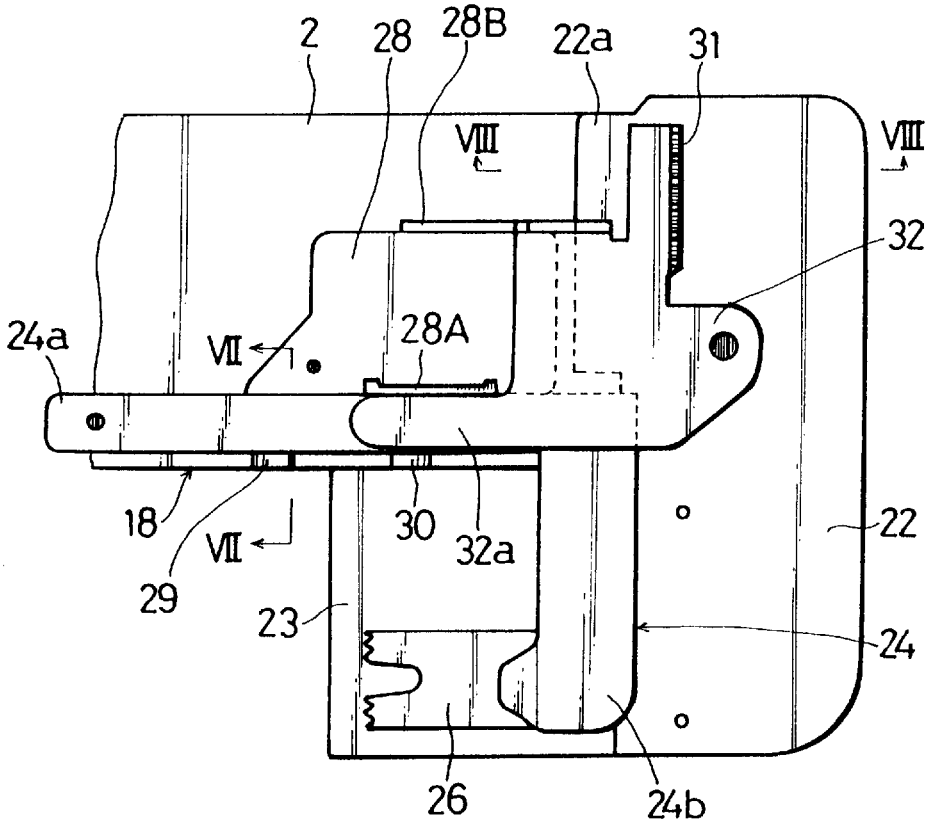
FIG. 6 is a plan view showing the mounting state of the work folding lever on the base plate.
Figure 7:
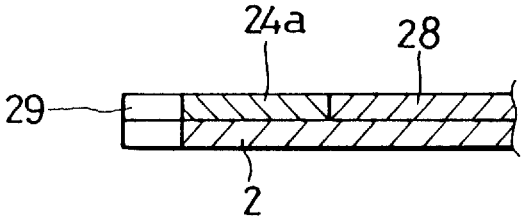
FIG. 7 is a sectional view taken along lines VII—VII in FIG. 6.
Figure 8:
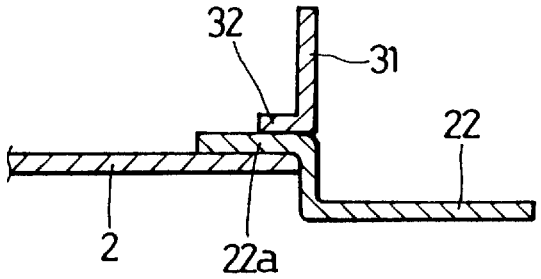
FIG. 8 is a sectional view taken along lines VIII—VIII in FIG. 6.

As shown in FIG. 6, a first support plate 28 for supporting cam disks 27A to 27F of the timing adjusting mechanism 12 is secured to the upper surface of the base plate 2 in the position on the right side of the slide bar part 24*a*. The left edge of the base plate 2 adjacent laterally of the cut-out 18 includes cut and raised parts 29 and 30 formed at different positions in the forward end rearward directions. As shown in FIG. 7, the cut and raised parts 29 and 30 cooperate with the first support plate 28 to prevent the slide bar part 24*a* from its lateral displacement or to provide a guide of the slide bar part 24*a* in the forward and rearward directions as shown in FIG. 7. A second support plate 32 is mounted on the base plate 2 in a position rearwardly of the first support plate 28. An adjusting lever engaging member 31 of the stroke adjusting mechanism 13 is formed integrally with the second support plate 32. The second support plate 32 has a front portion superposed on the first support plate 28 and has a rear portion superposed on the front portion 22*a* of the work guide plate 22 as shown in FIG. 8, so that the second support plate 32 is spaced from the base plate 2 for permitting movement of the slide bar part 24*a* of the work folding lever 24. In this connection, the front portion of the second support plate 32 includes an extension 32*a* which extends over the slide bar part 24*a*, so that the slide bar part 24*a* is prevented from moving in the vertical direction by the extension 32*a*.

The conversion mechanism 11 for converting the vertical pivotal movement of the pivotal lever 8 into the forward and rearward movements of the work folding lever 24 will now be explained.

Returning to FIG. 4, the conversion mechanism 11 mainly comprises a link mechanism which includes a first link member 33, the second link member 25 described above, and an intermediate link member 36 connected between the first link member 33 and the second link member 25. The first link member 33 and the second link member 25 are mounted on the base plate 2 by means of pins 34 and 35, respectively, so that the first link member 33 and the second link member 25 are pivotally movable within a plane parallel to the base plate 2. Each of the first link member 33, the second link member 25 and the intermediate link member 36 has a plate-like configuration. The first link member 33 has one end connected to the pivotal lever 8 by means of a vertical link member 37, so that the first line member 33 is pivoted within the plane parallel to the base plate 2 as the pivotal lever 8 is pivoted vertically. The other end of the first link member 33 includes an elongate slot 38 which has an arcuate configuration substantially about the axis of the pin 34. A pin 39 is fixed to one end of the intermediate link member 36 and is in engagement with the elongate slot 38. Since the first link member 33 and the intermediate link member 36 are connected by means of the elongate slot 38 and the pin 39, the pivotal movement of the first link member 33 may not be transmitted to the intermediate link member 36 because of movement of the pin 39 along the elongate slot 38. However, a switching mechanism 40 which constituting a part of the timing adjusting mechanism 12 is operable to prevent movement of the pin 39 along the elongate slot 38, so that the pivotal movement of the first link member 33 can be transmitted to the intermediate link member 36. The construction of the switching mechanism 40 will be explained later.

The other end of the intermediate link member 36 has a pin 42 fixed thereto. The pin 42 is in engagement with a substantially L-shaped slot 41 formed in the second link member 25. The second link member 25 has one end having the pin 35 and has the other end including a bifurcated portion 25*a*. A pin 43 is secured to the slide bar part 24*a* of the work folding lever 24 and is inserted into the bifurcated portion 25*a*, so that the pivotal movement of the intermediate link member 36 is converted into the forward and rearward movements of the work folding lever 24 (see FIG. 9). Here, the L-shaped slot 41 of the second link member 41 has a main slot part 41*a* and an auxiliary slot part 41*b*. The main slot part 41*a* extends substantially in the longitudinal direction of the second link member 41 or the direction in the radial direction from the pin 35 or the pivotal axis. The auxiliary slot part 41*b* extends substantially perpendicular to the main slot 41*a* from one end of the main slot 41*a* which is remote from the pin 35. With this arrangement, by varying the position of the pin 42 of the intermediate link member 36 along the main slot part 41*a*, the stroke of the forward and rearward movements of the work folding lever 24 as well as the stroke of pivotal movement of the second link member 25 can be varied. This operation will be explained later.

Figure 10:
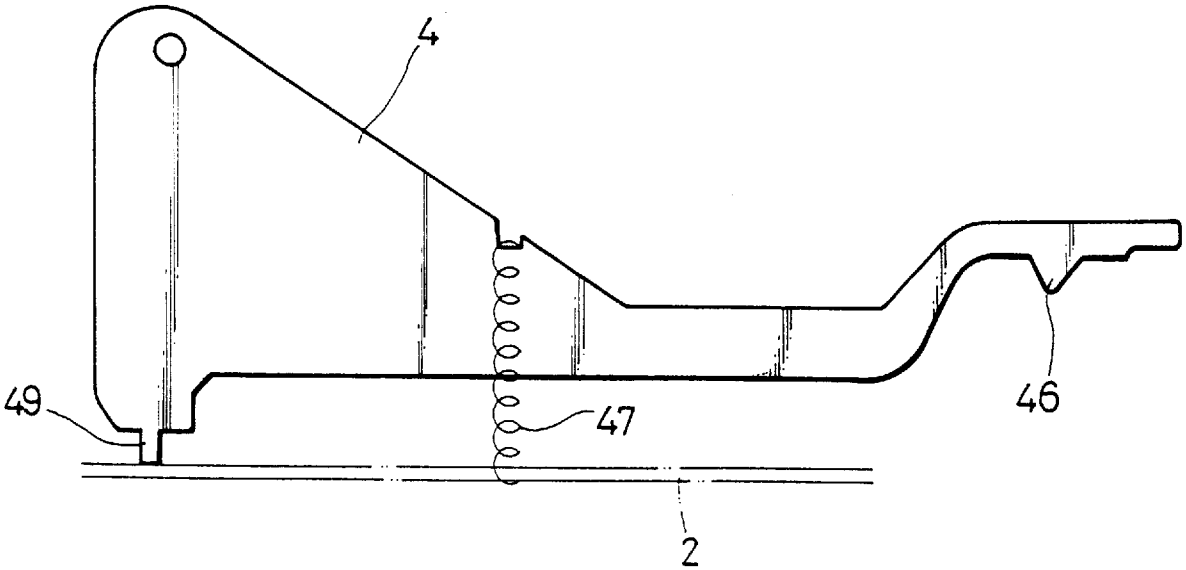
FIG. 10 is a side view of a timing adjusting lever.

The construction of the switching mechanism 40 will now be explained. An upstanding bracket 44 is secured to the front end of the base plate 2 in a position forwardly of the first link member 33. The timing adjusting lever 4 described above is pivotally mounted on the upper portion of the bracket 44 by means of a pin 68 and has a substantially triangular plate-like configuration as shown in FIG. 10. The timing adjusting lever 4 extends rearwardly over the first link member 33, the intermediate link member 36 and the second link member 25 to a position above the cam disks 27A to 27F. The rear end of the timing adjusting lever 4 has a claw 46 protruding downwardly therefrom. A tension coil spring 47 is mounted between the central portion of the timing adjusting lever 4 and the base plate 2, so that the timing adjusting lever 4 is normally biased in a direction in which the claw 46 is forced downwardly toward the cam disks 27A to 27F. Here, a compression coil spring 69 is interposed between the head of the pin 68 and a part of the timing adjusting lever 4 confronting thereto in spaced relationship therewith, so that the timing adjusting lever 4 can also be pivoted in the lateral direction relative to the bracket 44 for shifting the claw 46 to a position confronting any of the cam disks 27A to 27F.

Figure 11:
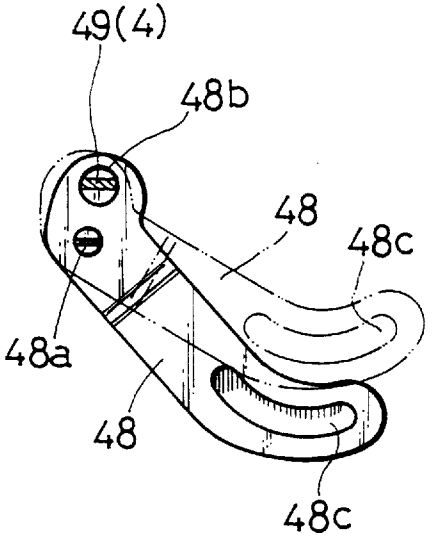
FIG. 11 is a plan view of a cam lever which is connected to one end of the timing adjusting lever.

A cam lever 48 is pivotally mounted on the base plate 2 in a position adjacent leftwardly of the bracket 44 and is pivotally movable within a plane parallel to the base plate 2. As shown in FIG. 11, one end of the cam lever 48 has a circular hole 48*b* for receiving a protrusion 49 formed on a front and lower portion of the timing adjusting lever 4 as shown in FIG. 10. The protrusion 49 has a narrow plate-like configuration, so that the protrusion 49 is rotatable within the circular hole 48*b* and can be tilted relative thereto to some extent. Therefore, as the timing adjusting lever 4 is vertically pivoted, the position of the protrusion 49 is varied in the forward and rearward directions, so that the cam lever 48 is pivoted.

The cam lever 48 has the other end which includes an arcuate cam slot 48*c* and which is bent in a stepped manner so as to extend over the first link member 33.

Figure 12:
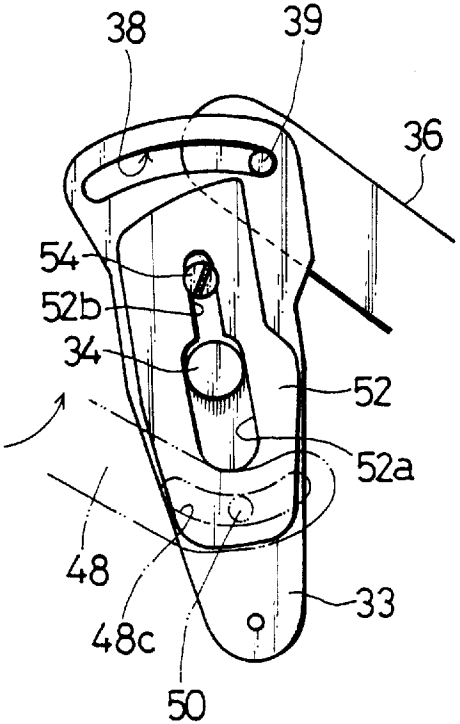
FIG. 12 is a plan view showing a first link member and an intermediate link member connected thereto.
Figure 13:
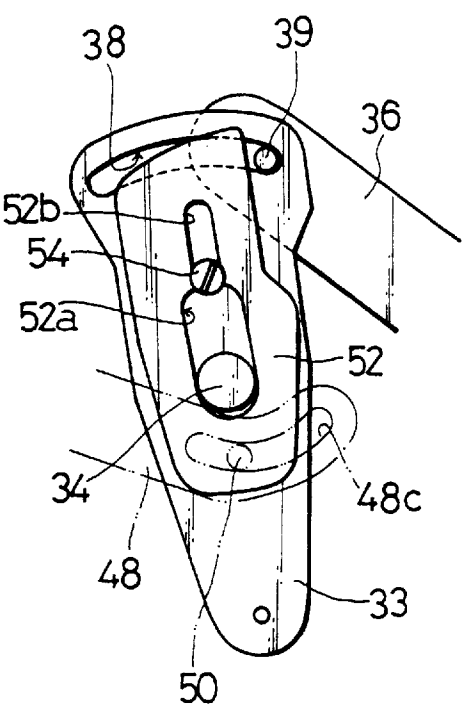
FIG. 13 is a view similar to FIG. 12 but showing the state where a switching plate is moved to permit transmission of movement between the first link member and the intermediate link member.

As shown in FIGS. 12 and 13, a switching plate 52 is placed on an upper surface of the first link member 33 and includes a pin 50 which is in engagement with the cam slot 48*c* of the cam lever 48. The switching plate 52 includes a first guide slot 52*a* and a second guide slot 52*b* formed in series in substantially the radial direction about the pin 34 of the first link member 33. The first guide slot 52*a* has a width slightly greater than the diameter of a head of the pin 34, so that the head of the pin 34 is in engagement with the first guide slot 52*a*. The second guide slot 52*b* has a width smaller than the first guide slot 52*a* and receives a shank of a pin 54 which is secured to the upper surface of the first link member 33. Thus, the switching plate 52 is slidably movable relative to the first link member 33 in the radial direction of the pin 34.

With this construction, when the cam lever 48 is pivoted by the movement of the timing adjusting lever 4, the switching lever 52 is moved relative to the first link member 33. When the rear end of the timing adjusting lever 4 is in an inoperative position or a position where the claw 36 does not engage any of the cam disks 27A to 27F as will be explained later, the switching plate 52 is held in a position away from the elongate slot 38 of the first link member 33 as shown in FIG. 12. On the other hand, when the rear end of the timing adjusting lever 4 is pivoted downwardly from the inoperative position to an operative position where the claw 46 is in engagement with any of the cam disks 27A to 27F, the switching plate 52 is moved to extend across the elongate slot 38 as shown in FIG. 13, so that the pin 39 of the intermediate link member 36 is put between the switching plate 52 and the edge of the elongate slot 38 of the first link member 33 in the clockwise direction in FIG. 13. The pivotal movement of the first link member 33 can therefore be transmitted to the intermediate link member 36, so that the work folding lever 24 is moved in the forward and rearward directions as described above.

Here, although the switching plate 52 is pivoted together with the first link member 33 and is therefore moved relative to the cam lever 48, such a movement of the switching plate 52 relative to the cam lever 48 can be absorbed by movement of the pin 50 relative to the cam slot 48*c* of the cam lever 48, so that no interference is caused.

Figure 14:
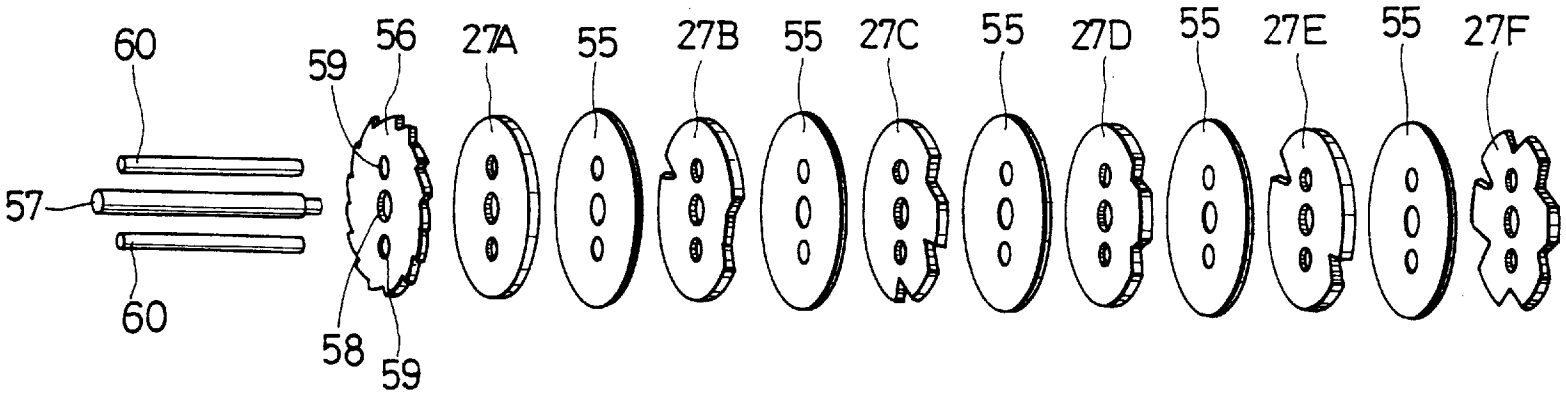
FIG. 14 is an exploded perspective view of cam disks and their related parts.
Figure 15A:
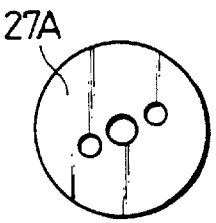
FIGS. 15(*a*) to 15(*f*) are front views of cam disks shown in FIG. 14.
Figure 15B:
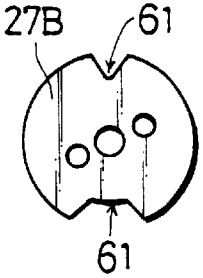
Figure 15C:
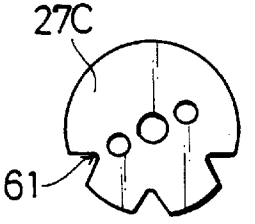
Figure 15D:
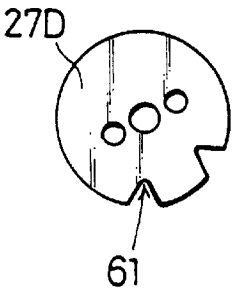
Figure 15E:
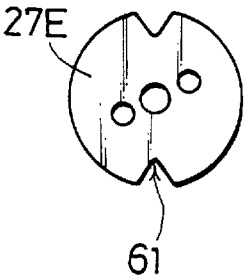
Figure 15F:
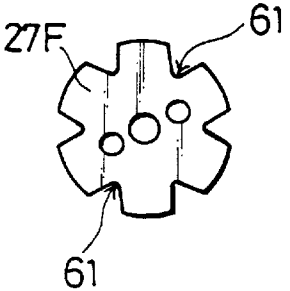
Figure 16:
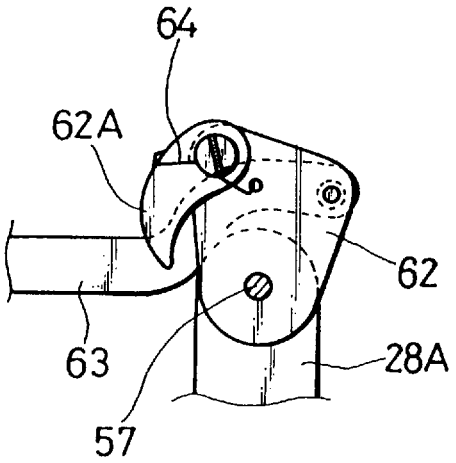
FIG. 16 is a side view showing a pivotal arm which includes a feeding claw for engagement with a ratchet wheel and which is mounted on a first support plate.

The cam disks 27A to 27F which cooperate with the switching mechanism 40 will now be explained. The cam disks 27A to 27F are rotatably supported between a pair of supports 28A and 28B (see FIG. 6) by means of a support shaft 57 (see FIG. 14). The supports 28A and 28B are formed integrally with the first support plate 28 and confront each other in the lateral direction of the base plate 2. A washer 55 is interposed between each two adjacent ones of the cam disks 27A to 27F and it has a diameter greater than that of the cam disks 27A to 27F. A ratchet wheel 56 is also rotatably supported on the support shaft 57. Here, each of the cam disks 27A to 27F, the washers 55 and the ratchet wheel 56 has an axial hole 58 and a pair of pin receiving holes 59 formed therein . The axial hole 58 is adapted to receive the support shaft 57. The pin receiving holes 59 are positioned in opposed relationship with each other in the diametrical direction about the axial hole 58. A pair of pins 60 are inserted through their corresponding pin receiving holes 59 of the cam disks 27A to 27F, the washers 55 and the ratchet wheel 56. Both ends of each of the pins 60 are enlarged so that by forcibly compressing the pins 60 from both sides by an appropriate tool, the cam disks 27A to 27F, the washers 55 and the ratchet wheel 56 are rotatable together about the support shaft 57. Here, the cam disks 27A to 27F, the washers 55 and the ratchet wheel 56 have the same diameter. As shown in FIGS. 15(*a*) to 15(*f*), the cam disk 27A does not have any cam recesses but has a smooth outer circumferential surface, while each of the cam disks 27B to 27F has at least one cam recess 61 formed on its outer circumferential surface. The number and the positions of the cam recesses 61 are different in each of the cam disks 27B to 27F. More specifically, the cam disk 27B has two cam recesses 61 formed in positions diametrically opposing to each other; the cam disk 27C has three cam recesses 61 formed in positions adjacent each other in the circumferential direction; the cam disk 27D has two cam recesses 61 formed in positions adjacent each other in the circumferential direction; the cam disk 27E has two cam recesses 61 formed in positions diametrically opposing to each other; and the cam disk 27F has six cam recesses formed in positions equally spaced from each other in the circumferential direction. Here, one of the cam recesses 61 of the cam disk 27B has a circumferential length twice that of the other, and the cam disk 27B is different from the cam disk 27E in this respect.

Figure 17:
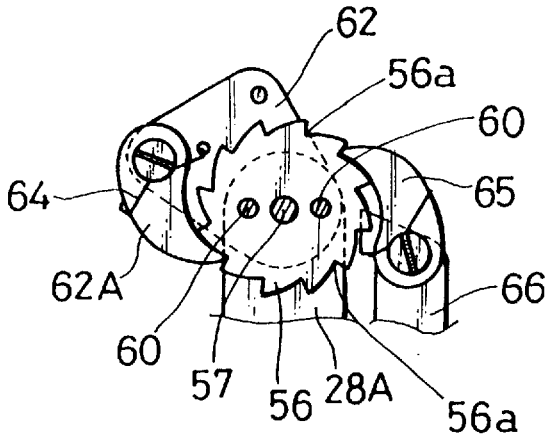
FIG. 17 is a side view showing the mounting state of the ratchet wheel on the first support plate.

The ratchet wheel 56 is positioned on the right side of the cam disks 27A to 27F. A pivotal plate 62 is positioned between the ratchet wheel 56 and the support 28A of the first support plate 28. The pivotal plate 62 is pivotally mounted on the support shaft 57 and is connected to the first link member 33 by means of a connecting arm 63, so that the pivotal plate 62 is pivoted vertically about the support shaft 57 as the first link member 33 is pivoted. As shown in FIG. 17, a feeding claw 62A is pivotally mounted on the front portion of the pivotal plate 62. The feeding claw 62A is normally biased in a direction toward the ratchet wheel 56 by means of a wire spring 64, so that the feeding claw 62A is brought to engage any one of teeth 56*a* of the ratchet wheel 56 for rotating the ratchet wheel 56 as the pivotal plate 62 is pivoted. A detent claw 65 is disposed rearwardly of the ratchet wheel 56 for preventing the ratchet wheel 56 from rotation in a direction opposite to the direction of rotation caused by the feeding claw 62A. The detent claw 65 is pivotally mounted on a support bracket 66 positioned rearwardly adjacent the first support plate 28 and is normally biased in a direction toward the ratchet wheel 56 by means of a wire spring 67. With this construction, as the first link member 33 is pivoted to perform one reciprocal movement or as the needle bar N is moved vertically to perform one reciprocal movement, the ratchet wheel 56 is rotated by one pitch of the teeth 56*a*, so that the cam disks 27A to 27F are rotated intermittently as the needle bar N is vertically reciprocally moved.

Since the washer 55 having the diameter greater than that of the cam disks 27A to 27F is interposed between each two adjacent ones of the cam disks 27A to 27F, the rear end of the timing adjusting lever 4 may be held between the washers 55 in the lateral direction when the rear end is shifted to a position confronting any one of the cam disks 27A to 27F. Here, the ratchet wheel 56 and the support 28B of the first support plate 28 may perform the same function as the washers 55 when the rear end confronts the cam disk 27A and the cam disk 27F, respectively. The timing adjusting lever 4 can therefore be held in any of desired shifted positions.

For example, when the rear end of the timing adjusting lever 4 is positioned to confront the cam disk 27A, the claw 46 abuts on the peripheral surface of the cam disk 27A. Since the cam disk 27A has no cam recesses 61, the timing adjusting lever 4 is held in the inoperative position where the switching plate 52 is held in a position away from the elongate slot 38 of the first link member 33. Therefore, the pivotal movement of the first link member 33 may not be transmitted to the intermediate link member 36, and the work folding lever 24 is held not to be moved. Thus, a normal sewing operation which does not accompany the ruffling operation can be performed.

Figure 18:
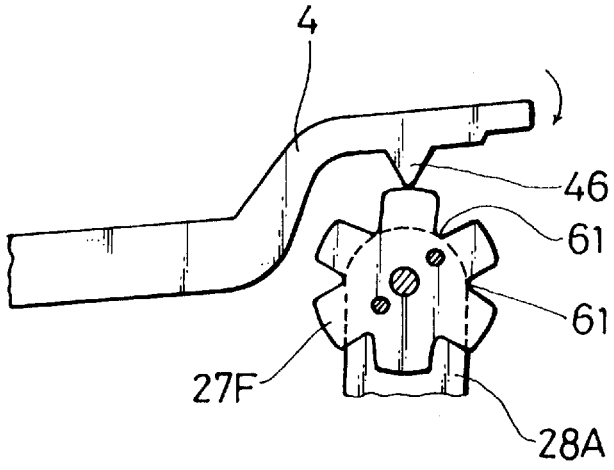
FIG. 18 is a side view showing the relation between the timing adjusting lever and one of the cam disks.
Figure 19:
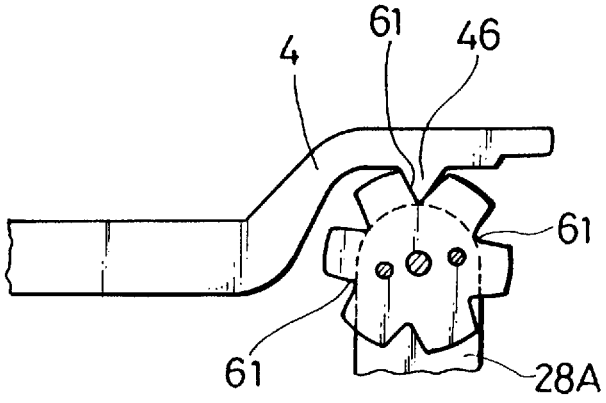
FIG. 19 is a view similar to FIG. 18 but showing the state where the timing adjusting lever is in an operative position for engagement with one of cam recesses of the cam disks.

When the rear end of the timing adjusting lever 4 is shifted to confront the cam disk 27F, the claw 46 abuts on the peripheral surface of the cam disk 27F as shown in FIG. 18. Since the cam recesses 61 are formed in the cam disk 27F, the timing adjusting lever 4 is moved from the inoperative position to the operative position when the cam disk 27F is rotated to a position where the claw 46 is brought to engage any one of the cam recesses 61 as shown in FIG. 19. Thus, the timing adjusting lever 4 is pivoted in such a direction that its rear end is moved downwardly, so that the switching plate 52 is moved to extend across the elongate slot 38 of the first link member 33 as explained previously with reference to FIGS. 12 and 13. Here, the positions of the cam recesses 61 are determined such that the switching plate 52 is moved to extend across the elongate slot 38 when the needle bar N is in its upper dead center or when the pivotal lever 8 is in its uppermost pivotal end or when the first link member 33 is in its pivotal end in the counterclockwise direction in FIG. 4 (where the pin 39 of the intermediate link member 36 is positioned at one end of the elongate slot 38). Therefore, as the needle bar N is moved downwardly from its upper dead center with the claw 64 in engagement with one of the cam recesses 61, the second link member 25 is pivoted in the counterclockwise direction in FIG. 4 by the first link member 33, so that the work folding lever 24 is moved away from the presser foot 10 or is moved rearwardly to reach a rearmost position indicated by chain lines in FIG. 4 when the needle bar N is at its lower dead center. As the needle bar N is moved upwardly from the lower dead center, the work folding lever 24 is moved from the rearmost position toward the presser foot 10 and goes below the presser foot 10, so that the work folding lever 24 reaches its frontmost position when the needle bar N returns to its upper dead center. At the same time when the needle bar N reaches its upper dead center, the claw 46 is disengaged from the cam recess 61 because of rotation of the cam disk 27F, so that the timing adjusting lever 4 is moved from the operative position to the inoperative position. The transmission of movement between the first link member 33 and the intermediate link member 36 is therefore disconnected, and the work folding lever 24 is stopped at its frontmost position. As the cam disk 27F is further rotated, the claw 46 is brought to engage the next cam recess 61, so that the same operation is again performed.

The function of the cam recesses 61 of the cam disks 27B to 27E is the same as the cam recesses 61 of the cam disk 27A. Since the cam recesses 61 are formed in the cam disks 27B to 27E in different numbers and in different pitches, the work folding lever 24 is moved at different timings and in different numbers of stroke movement during one rotation of cam disks 27B to 27E. Here, as described above, one of the cam recesses 61 has the circumferential length twice that of the other, so that the work folding lever 24 performs the stroke movement by two times in succession.

The stroke adjusting mechanism 13 for adjusting the stroke of movement of the work folding lever 24 will now be explained.

Figure 20:
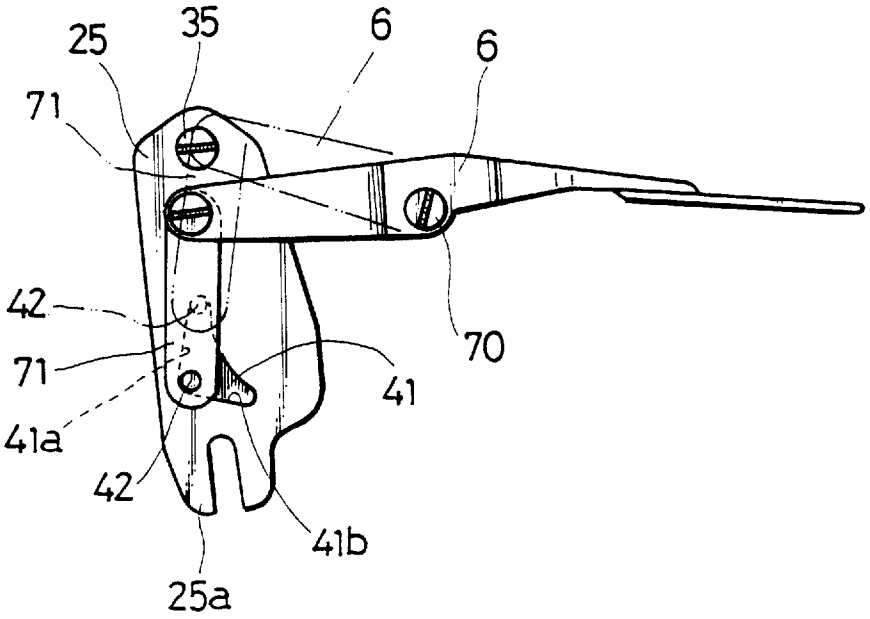
FIG. 20 is a plan view showing the operation of a pin of the intermediate link member relative to the second link member as the stroke adjusting lever is pivoted.

The stroke adjusting lever 6 is mounted on the base plate 2 by means of a pin 70 (see FIG. 20) in a position rightwardly of the first support plate 28, so that the stroke adjusting lever 6 is pivotable within a plane parallel to the base plate 2. As shown in FIG. 20, the stroke adjusting lever 6 has one end pivotally connected to a connection member 71 which is in turn pivotally connected to the pin 42 of the intermediate link member 36. As described previously, the pin 42 is in engagement with the L-shaped slot 41 of the second link member 25. Therefore, when the stroke adjusting lever 6 is pivoted, the position of the pin 42 of the intermediate link member 36 is varied along the main slot part 41a of the L-shaped slot 41, so that the stroke of movement of the work folding lever 24 as well as the stroke of pivotal movement of the second link member 25 is varied. Thus, the stroke of movement of the second link member 25 becomes smaller as the position of the pin 42 is moved away from the pin 35 or the pivotal center of the second link member 25.

Figure 21:
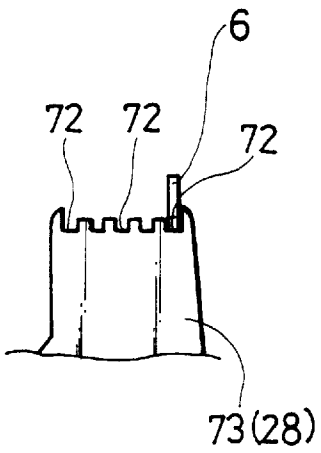
FIG. 21 is a front view showing the stroke adjusting lever which is in engagement with one of engaging recesses of an upstanding plate.

In order to hold the stroke adjusting lever 6 in position, a plurality of engaging recesses 72 (see FIG. 21) are formed in the upper end of an upstanding plate 73 which is formed integrally with the second support plate 28 and which is positioned rearwardly of the cam disks 27A to 27F. The stroke adjusting lever 6 can therefore be held in a desired shift position through engagement of its rear end with any of the engaging recesses 72. Other than the rear end, the stroke adjusting lever 6 has a plate-like configuration having the thickness in the vertical direction, so that a part of the stroke adjusting lever 6 extending rearwardly from the pin 70 can be resiliently deformed to vary the vertical position of the rear end. Therefore, in order to vary the shift position of the stroke adjusting lever 6, an operator pulls up the rear end of the stroke adjusting lever 6 upwardly and moves laterally to a position where the rear end confronts another engaging recess 72 which is desired to be engaged. The operator threafter releases the rear end of the stroke adjusting lever 6, so that the rear end is automatically brought to engage the desired engaging recess 72. In this embodiment, five engaging recesses 72 are provided, so that five different strokes can be obtained. In addition, when the rear end is in engagement with the engaging recess 72 which is positioned on the rearmost position (shortest stroke position) as shown in FIG. 21, the pin 42 in the L-shaped slot 41 of the second link member 25 is in a position where the auxiliary slot part 41*b* intersects the main slot part 41*a*. Therefore, with this position, the pivotal stroke of the second link member 25 further becomes shorter by the length of the auxiliary slot part 41*b* (more specifically, by the distance between the positions of the center of the pin 42 when the pin 42 is in one end of the auxiliary slot part 41*b* and in the other end thereof, respectively). The stroke of the work folding lever 24 therefore becomes further shorter.

Figure 22:
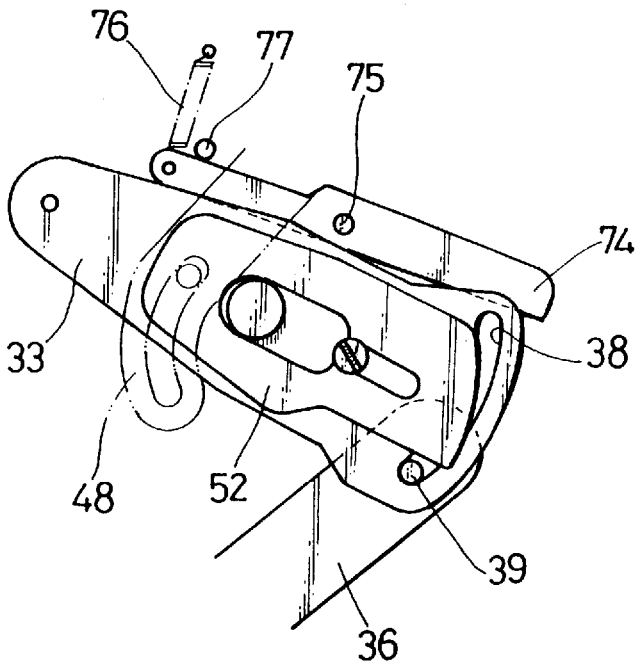
FIG. 22 is a plan view showing the relation among the first link member, the intermediate link member and a damper lever.

As shown in FIG. 22, a damper lever 74 is disposed adjacent and laterally of the first link member 33. The damper lever 74 has a central portion which is mounted on the base plate 2 by means of a pin 75, so that the damper lever 74 is pivotally movable within a plane parallel to the base plate 2. A spring 76 has one end connected to one end of the damper lever 74 and has the other end connected to the base plate 2, so that the damper lever 74 is normally biased in the clockwise direction in FIG. 22. A stopper 77 is fixed to the base plate 2 and is positioned adjacent one end of the damper lever 74, so that the damper lever 74 is normally held in a position where one end of the damper lever 74 is in abutment on the stopper 77.

Figure 23:
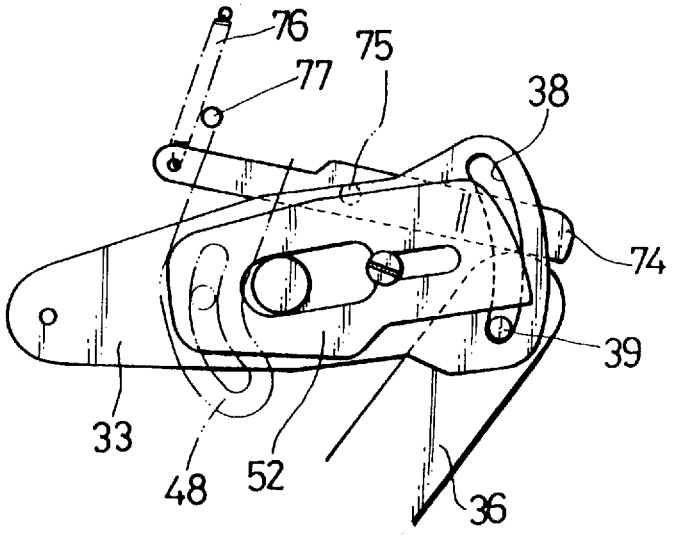
FIG. 23 is a plan view similar to FIG. 22 but showing the state where the intermediate link member is in abutment on the damper lever.

As shown in FIG. 23, the damper lever 74 serves to abut on the intermediate link member 36 immediately before the first link member 33 reaches its pivotal end in the counter-clockwise direction during the pivotal movement of the intermediate link member 36 which is connected to the first link member 33 by the switching plate 52 when the timing adjusting lever 4 is in the operative position. Therefore, although an inertia force may be applied to the intermediate link member 36 to move the pin 39 along the elongate slot 38, such an inertia force may be balanced by the abutment of the intermediate link member 36 on the damper lever 74. In addition, although the pin 39 is prevented from moving relative to the elongate slot 38 by the switching plate 52, the pin 39 may be permitted to move relative to the elongate slot 38 by a small distance because of design in an actual device. In such a case, the pin 39 may abut on the switching plate 52 by the inertial force. The damper lever 74 can also serve to prevent abrupt abutment of the pin 39 on the switching plate 52.

The operation of the above embodiment will now be expl ained.

Figure 24:
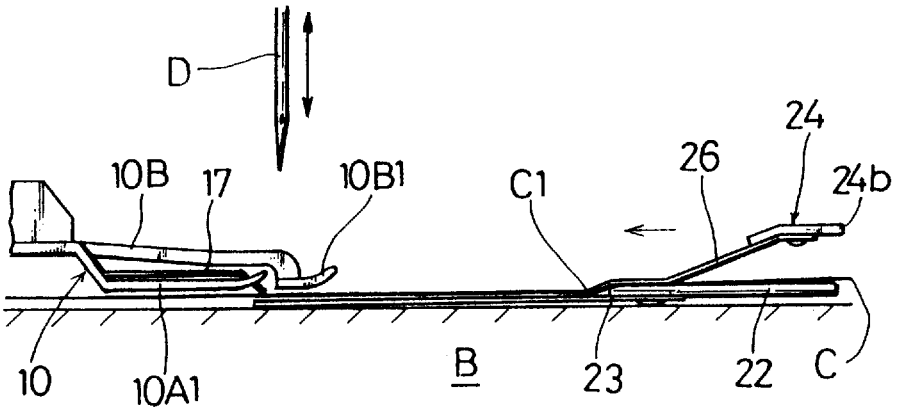
FIG. 24 is an explanatory side view showing a work fabric set on the device.

The operator shifts the stroke adjusting lever 6 to the desired position and shifts the timing adjusting lever 4 to the position confronting any of the cam disks 27A to 27F. Then, he sets a work fabric C in an ordinary manner as shown in FIG. 24, so that the work fabric C is placed between the presser foot 10 and the bed B and extends in the forward and rearward directions. For illustration purpose, in FIGS. 24 to 26, there is provided a space between the bed B and the work fabric C as well as between the work fabric C and the presser foot 10. No substantial space is however provided in the actual device.

When the sewing machine M is driven with the timing adjusting lever 4 in abutment on the cam disk 27A, the timing adjusting lever 4 is held in the inoperative position, so that the movement of the pivotal lever 8 is not transmitted to the second link member 25 and to the work folding lever 24. Thus, the work folding lever 24 is held in position, and normal straight stitches are formed on the work C without formation of ruffles as shown in FIG. 27(*a*).

When the sewing machine M is driven with the timing adjusting lever 4 shifted to abut on the cam disk 27B, the work folding lever 24 is once moved rearwardly and is thereafter moved to its frontmost position as the timing adjusting lever 4 is brought to engage the cam recess 61 and is thereafter disengaged therefrom. This movement of the work folding lever 24 is performed in synchronism with one stroke movement of the needle bar N starting from the upper dead center.

Figure 25:
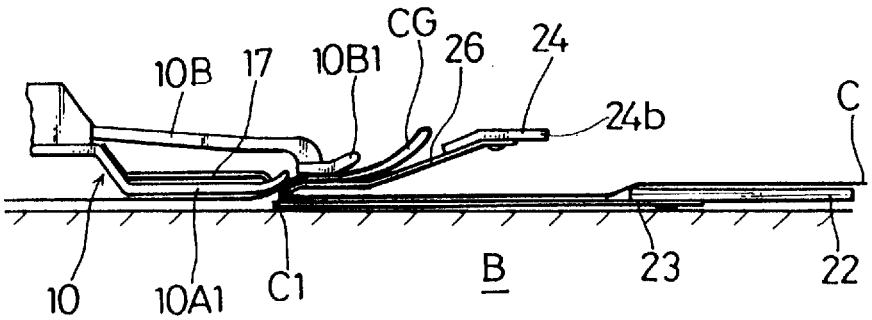
FIG. 25 is a side view similar to FIG. 24 but showing the state where a ruffle is formed by the work folding lever.
Figure 26:
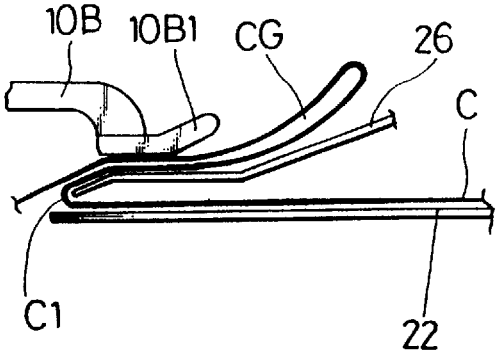
FIG. 26 is an enlarged view of the essential parts shown in FIG. 25.
Figure 27A:
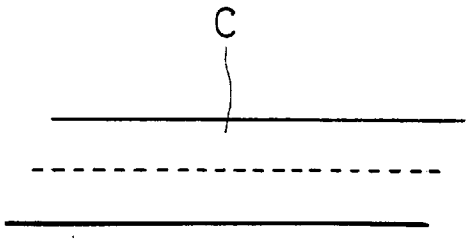
FIGS. 27(*a*) to 27(*f*) show the work fabrics formed with stitches and ruffles which are formed using cam disks shown in FIGS. 15(*a*) to 15(*f*), respectively.
Figure 27B:
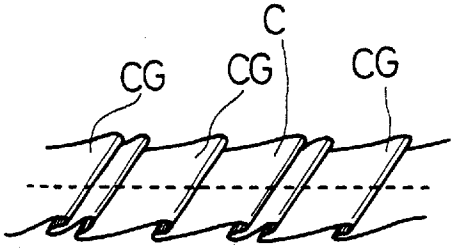
Figure 27C:
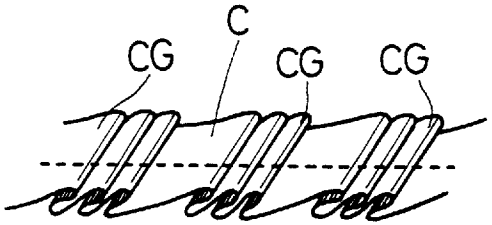
Figure 27D:
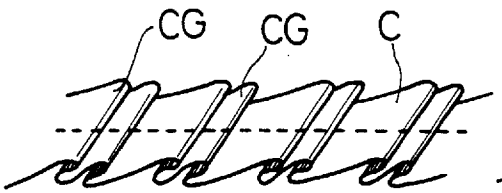
Figure 27E:
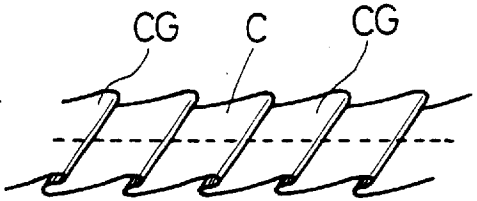
Figure 27F:
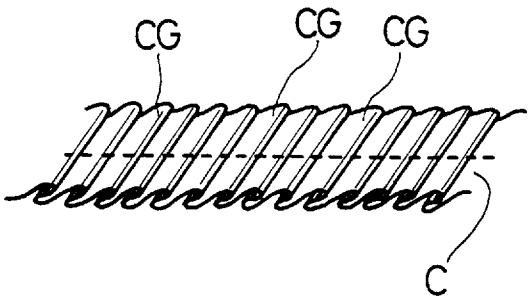

Thus, as the needle bar N is moved from the lower dead center to the upper dead center, a part C1 of the work fabric C held between the work folding plate 26 and the spring plate 23 is moved to a position below a part of the work fabric C positioned forwardly of the part C1, and the work folding plate 26 then enters between the rear end 10B1 of the auxiliary foot part 10B and the spring plate 23, so that a ruffle CG is formed as shown in FIG. 25. In this state, between the rear end 10B1 of the auxiliary foot part 10B and the spring plate 23, there exists a ruffle CG, the work folding plate 26 and the part C1 of the work fabric C in succession being moved in the downward direction. Therefore, the auxiliary foot part 10B1 is slightly lifted against the force of the spring 21 as shown in FIG. 26. As the needle bar N is moved from its upper dead center to the lower dead center, the work folding plate 26 is removed from the ruffle CS, and the work fabric C thus formed with the ruffle CS is then moved forwardly by the feed dog of the sewing machine M and stitches are formed on the work fabric C by the sewing needle D in a usual manner.

Here, in case of the cam disk 27B, the cam recesses 61 are formed in positions diametrically opposed to each other and they includes one having the circumferential length twice that of the other. Therefore, when the timing adjusting lever 4 is brought to engage the cam recess 61 having the greater circumferential length, the stroke movement of the work folding lever 24 from the frontmost position to return to the frontmost position via the rearmost position is performed twice in succession, so that two ruffles CG are formed in succession. Thus, in case of the cam disk 27B, a combination of two folds of the ruffle CG and a single fold of the ruffle CG can be repeatedly formed in equally spaced manner as shown in FIG. 27(*b*).

For the same reason as described above, in case of the cam disk 27C, a group of three folds of the ruffle CG can be repeatedly formed in equally spaced manner; in case of the cam disk 27D, a group of two folds of the ruffle CG can be repeatedly formed in equally spaced manner; in case of the cam disk 27E, a single fold of the ruffle CG can be formed in a plural number in equally spaced manner; and in case of the cam disk 27F, the ruffles CG are formed in succession with each other.

During the sewing operation, a part of the thread extending from the stitch just formed may be held to be pressed on the work fabric C by the spring plate 17 which is mounted on the main foot part 10A and which protrudes into the recess 10A1 of the main foot part 10A. Therefore, the sewing operation can be reliably performed.

While the invention has been described with reference to a preferred embodiment thereof, it is to be understood that modifications or variations may be easily made without departing from the spirit of this invention which is defined by the appended claims.

What is claimed is:

1. A ruffling device adapted for mounting on a sewing machine, comprising:

a) a base for attachment to a presser bar of the sewing machine;

b) a pivotal lever mounted on said base and adapted to be connected to a needle bar of the sewing machine, so that said pivotal lever may be reciprocally pivoted as a needle bar is vertically reciprocally moved;

c) a work folding lever for folding a work fabric and movable in forward and rearward directions with respect to a feeding direction of the work fabric for a sewing operation;

d) motion conversion means for converting the pivotal movement of said pivotal lever into the forward and rearward movement of said work folding lever, so that said work folding lever cooperates with a presser foot mounted on said base for forming a ruffle on the work fabric;

e) timing adjusting means for adjusting an operation timing of said work folding lever; and f) stroke adjusting means for adjusting a stroke of movement of said work folding lever in the forward and rearward directions;

said motion conversion means including a link mechanism having a plurality of link members connected to each other;

said timing adjusting means including:

a plurality of cam disks intermittently rotated by said pivotal lever, each of said cam disks having a predetermined number of cam recesses formed on an outer circumferential surface thereof;

a timing adjusting lever operable by an operator for selectively cooperating with one of said cam disks, said timing adjusting lever having a claw for engagement with said recesses, so that said timing adjusting lever is movable between an operative position where said claw is in engagement with one of said cam recesses and an inoperative position where said claw abuts on said outer circumferential surface other than said cam recesses;

a switching means provided between said timing adjusting lever and said link mechanism for connecting said link mechanism to said work folding lever when said timing adjusting lever is in the operative position and to disconnect said link mechanism from said work folding lever when said timing adjusting lever is in the inoperative position;

said stroke adjusting means including a stroke adjusting lever operable by the operator for varying the stroke of pivotal movement of any of the link members of said link mechanism.

2. The ruffling device as defined in claim 1 wherein:

the link members of said link mechanism comprise a first link member pivotally connected to said pivotal lever, a second link member pivotally connected to said work folding lever, and an intermediate link member connected between said first link member and said second link member;

said first link member and said intermediate link member being connected to each other by means of an elongate slot formed in said first link member and a pin provided on said intermediate link member for engagement with said elongate slot;

said switching means includes a switching lever mounted on said first link member and connected to said timing adjusting lever, said switching lever being movable between a connecting position and a disconnecting position;

said switching lever in said connecting position extending across said elongate slot for preventing said pin from moving relative to said elongate slot, so that a pivotal movement of said first link member is transmitted to said intermediate link member; and said switching lever in said disconnecting position being positioned away from said elongate slot for permitting movement of said pin relative to said elongate slot, so that the pivotal movement of said first link member is not transmitted to said intermediate link member.

3. The ruffling device as defined in claim 2 wherein:

said intermediate link member and said second link member are connected to each other by means of a second pin provided on said second link member and a second elongate slot formed in said second link member; and said stroke adjusting lever is connected to said second pin and is operable to change the position of said second pin relative to said second elongate slot so as to vary the distance between a pivotal axis of said second link member and said second pin, whereby the stroke of pivotal movement of said second link member is varied.

4. The ruffling device as defined in claim 1 wherein:

the cam disks of said timing adjusting means are mounted on a support shaft and are rotatable together relative to said support shaft; and said timing adjusting means further includes a ratchet wheel rotatable with said cam disks, detent means for permitting rotation of said ratchet wheel in only one direction, a connecting arm configured to be pivoted by said pivotal lever, and a feeding claw provided on said connecting arm for engagement with said ratchet wheel, so that said cam disks are intermittently rotated as said ratchet wheel is rotated through engagement of said feeding claw with said ratchet wheel for each pivotal movement of said connecting arm.

* * * * *